US008522751B2

(12) United States Patent
DeLeon

(10) Patent No.: US 8,522,751 B2
(45) Date of Patent: Sep. 3, 2013

(54) FUEL PRESSURE REGULATOR FOR A MOTOR VEHICLE

(75) Inventor: Marcos J. DeLeon, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 417 days.

(21) Appl. No.: 12/873,706

(22) Filed: Sep. 1, 2010

(65) Prior Publication Data

US 2012/0048238 A1 Mar. 1, 2012

(51) Int. Cl.
*F02M 59/36* (2006.01)

(52) U.S. Cl.
USPC .. 123/458; 137/909; 251/129.01; 251/129.06

(58) Field of Classification Search
USPC ..... 123/457, 458, 506, 510, 511, 512, 123/514; 251/30.03; 137/514.5, 909
See application file for complete search history.

(56) References Cited

U.S. PATENT DOCUMENTS

| | | | | | |
|---|---|---|---|---|---|
| 3,744,508 | A | * | 7/1973 | Hansen et al. | 137/116.3 |
| 4,250,848 | A | | 2/1981 | Wessel et al. | |
| 4,404,944 | A | * | 9/1983 | Yamazaki et al. | 123/458 |
| 4,419,976 | A | * | 12/1983 | Hosaka | 123/458 |
| 4,829,964 | A | * | 5/1989 | Asayama | 123/463 |
| 5,063,898 | A | | 11/1991 | Elliott | |
| 5,117,798 | A | * | 6/1992 | Nozaki | 123/527 |
| 5,158,109 | A | * | 10/1992 | Hare, Sr. | 137/514.3 |
| 5,452,745 | A | * | 9/1995 | Kordonsky et al. | 137/807 |
| 5,873,349 | A | * | 2/1999 | Tuckey et al. | 123/514 |
| 6,123,312 | A | * | 9/2000 | Dai | 248/550 |
| 6,158,975 | A | | 12/2000 | Dill et al. | |
| 6,209,527 | B1 | * | 4/2001 | Bueser et al. | 123/514 |
| 6,546,913 | B2 | * | 4/2003 | Hopley | 123/457 |
| 6,626,150 | B2 | * | 9/2003 | Palma | 123/458 |
| 6,701,905 | B1 | * | 3/2004 | Gaskins | 123/674 |
| 6,764,058 | B1 | * | 7/2004 | Brenk et al. | 251/54 |
| 6,918,381 | B2 | * | 7/2005 | Palvolgyi | 123/514 |
| 7,302,938 | B2 | | 12/2007 | Yu et al. | |
| 7,624,720 | B1 | * | 12/2009 | Dokas et al. | 123/458 |
| 7,975,673 | B2 | * | 7/2011 | Alajoki et al. | 123/445 |
| 8,210,156 | B2 | * | 7/2012 | Kokotovic et al. | 123/458 |
| 2005/0103289 | A1 | * | 5/2005 | Petrie | 123/90.11 |
| 2006/0065242 | A1 | * | 3/2006 | Nagai | 123/458 |

FOREIGN PATENT DOCUMENTS

| | | | |
|---|---|---|---|
| JP | 63083476 | A * | 4/1988 |
| SU | 717417 | A * | 2/1980 |

* cited by examiner

*Primary Examiner* — Stephen K Cronin
*Assistant Examiner* — John Zaleskas
(74) *Attorney, Agent, or Firm* — Plumsea Law Group, LLC

(57) ABSTRACT

A fuel pressure regulation system for a motor vehicle includes a fuel pressure regulator in communication with an electronic control device (ECU). The regulated pressure of the fuel pressure regulator can be varied by applying electrical signals from the ECU. According to one embodiment, a length of a spring is adjusted to vary the regulated fuel pressure. According to another embodiment, a viscosity of a fluid is adjusted to vary the pressure.

12 Claims, 5 Drawing Sheets

FUEL PRESSURE REGULATOR FOR A MOTOR VEHICLE

BACKGROUND

The present invention relates generally to a motor vehicle, and in particular to a fuel pressure regulator for a motor vehicle.

Fuel pressure regulators have been previously proposed. Spring based pressure regulators are known that use spring force to control a valve that provides fluid communication to a return fuel line. However, the fuel pressure regulators of the related art do not allow for an efficient method of varying the regulated fuel pressure. There is a need for a design that overcomes these shortcomings of the related art.

SUMMARY

In one aspect of the invention, a fuel pressure regulation system for a motor vehicle includes a fuel pressure regulator, a spring having a first end portion and a second end portion, a sealing member, an electrical actuating device and an electronic control unit. The fuel pressure regulator includes a first fluid port for receiving pressurized fuel, a second fluid port in fluid communication with a fuel rail and a third fluid port for returning fuel to a fuel tank. The sealing member is mounted to the first end portion of the spring and has a closed position that prevents fluid communication between the first fluid port and the third fluid port. The sealing member has an open position that allows fluid communication between the first fluid port and the third fluid port; the position of the sealing member being determined by the pressure inside the fuel pressure regulator and a length of the spring. The electrical actuating device is configured to adjust the length of the spring and the electronic control unit is configured to send electrical signals to the electrical actuating device to adjust the length of the spring.

In another aspect of the invention, a fuel pressure regulation system for a motor vehicle includes a fuel pressure, a fluid filled member capable of deforming and having a set of electrodes, a sealing member, and an electronic control unit. The fuel pressure regulator includes a first fluid port for receiving pressurized fuel, a second fluid port in fluid communication with a fuel rail and a third fluid port for returning fuel to a fuel tank. The fluid filled member is filled with a fluid having an adjustable viscosity. According to one embodiment, the fluid is an electrorheological fluid. According to another embodiment, the fluid is a magnetorheological fluid. The sealing member has a closed position that prevents fluid communication between the first fluid port and the third fluid port and an open position that allows fluid communication between the first fluid port and the third fluid port. The position of the sealing member is determined by the pressure inside the fuel pressure regulator and a viscosity of the adjustable viscosity fluid. The electronic control unit is configured to send electrical signals to the electrodes and the electronic control unit adjusts the regulated fuel pressure by sending electrical signals to the electrodes in order to adjust the viscosity of the fluid of the fluid filled member.

In another aspect of the invention, a fuel pressure regulation system for a motor vehicle includes a fuel pressure regulator, and an electronic control unit in communication with the fuel pressure regulator. The electronic control unit adjusts a regulated pressure of the fuel pressure regulator using electrical signals.

Other systems, methods, features and advantages of the invention will be, or will become apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
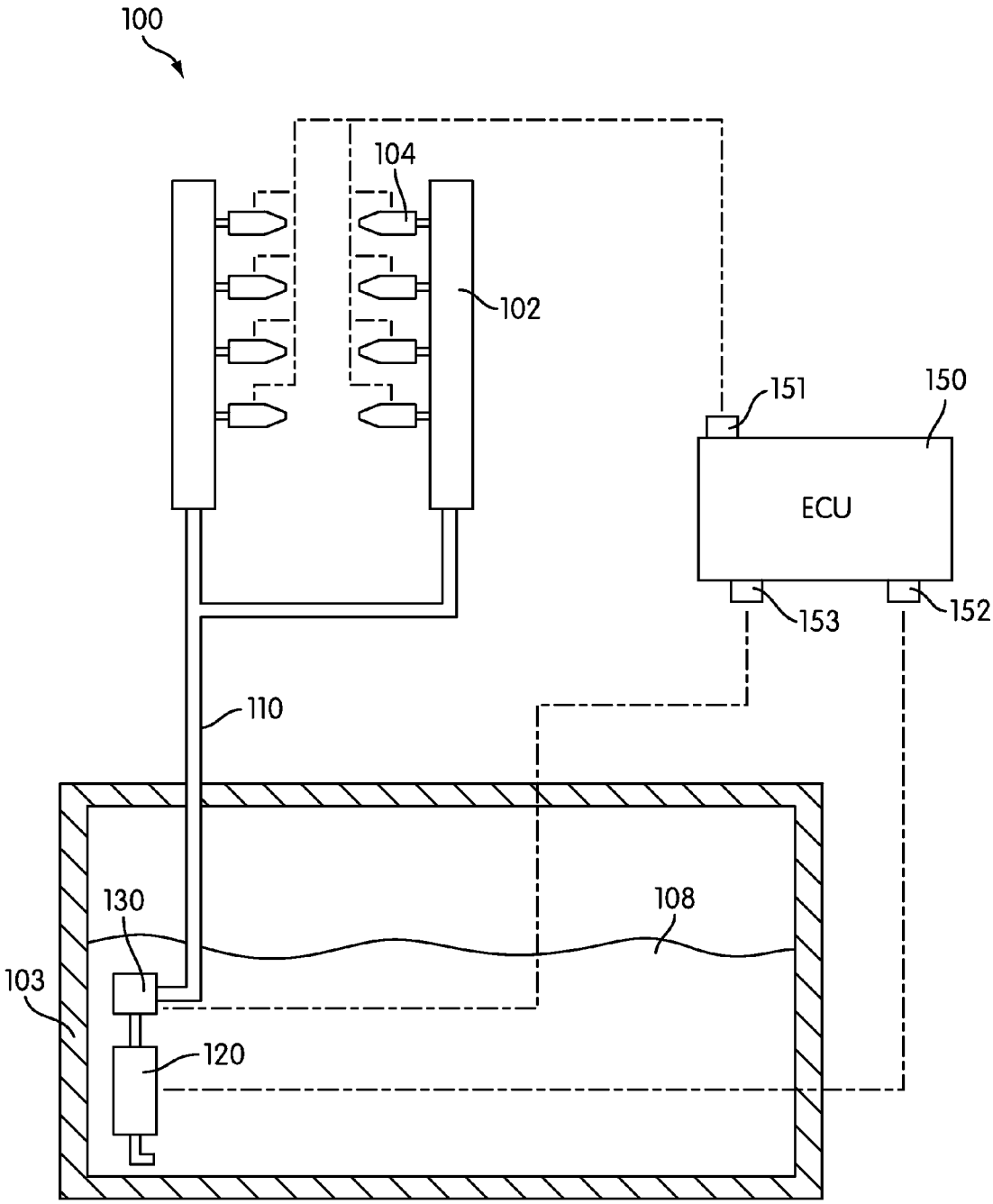
FIG. 1 is a schematic view of an embodiment of a fuel system for a motor vehicle.

FIG. 1 is a schematic view of a fuel system 100 of a motor vehicle. The term "motor vehicle" as used throughout the specification and claims refers to any moving vehicle that is capable of carrying one or more human occupants and is powered by any form of energy. The term "motor vehicle" includes, but is not limited to: cars, trucks, vans, minivans, SUVs, motorcycles, scooters, boats, personal watercraft, and aircraft. In one exemplary embodiment, motor vehicle 100 may be a sports utility vehicle (SUV).

In some cases, the motor vehicle includes one or more engines. The term "engine" as used throughout the specification and claims refers to any device or machine that is capable of converting energy. In some cases, potential energy is converted into kinetic energy. For example, energy conversion can include a situation where the chemical potential energy of a fuel or fuel cell is converted into rotational kinetic energy or where electrical potential energy is converted into rotational kinetic energy. Engines can also include provisions for converting kinetic energy into potential energy. For example, some engines include regenerative braking systems where kinetic energy from a drivetrain is converted into potential energy. Engines can also include devices that convert solar or nuclear energy into another form of energy. Some examples of engines include, but are not limited to: internal combustion engines, electric motors, solar energy converters, turbines, nuclear power plants, and hybrid systems that combine two or more different types of energy conversion processes.

Generally, the fuel system 100 may be configured to store and deliver fuel to an engine. In some embodiments, the fuel system 100 may deliver fuel to individual fuel injectors of an engine. In an exemplary embodiment, the fuel system 100 may deliver fuel to fuel rails 102 of an engine. The fuel rails 102 may be further associated with fuel injectors 104 that distribute fuel to individual cylinders of an engine. In particular, the fuel injectors 104 may be in fluid communication with the fuel rails 102.

The fuel system 100 includes a fuel tank 103. The fuel tank 103 may be configured to store a fuel 108 for an engine. In some embodiments, the fuel tank 103 may store a mixed fuel. For example, in some cases, a mixed fuel may be a mixture of gasoline and ethanol. Generally, mixtures of gasoline and ethanol can include different proportions of ethanol including, but not limited to: E20, E75 and E80. In other embodiments, the fuel tank 103 may store a single type of fuel such as gasoline.

In some embodiments, the fuel system 100 can be configured with one or more fuel lines for delivering fuel to the fuel rails 102. In one embodiment, the fuel system 100 can include a fuel line 110. The fuel line 110 can be any type of tubing or piping that provides fluid communication between the fuel rails 102 and the fuel tank 103. Furthermore, it will be understood that in different embodiments the fuel line 110 can comprise any number and/or configuration of fuel lines for delivering fuel between the fuel tank 103 and the fuel rails 102.

The fuel system 100 can include provisions for pumping fuel from the fuel tank 103. In some embodiments, the fuel system 100 may include a fuel pump 120. For purposes of illustration, the fuel pump 120 is shown in a corner of the fuel tank 103 in the current embodiment. However, in other embodiments, the fuel pump 120 can be disposed in any other location within the fuel tank 103. In addition, the fuel pump 120 could be optional in some embodiments. For example, in some cases, a gravity feed type system could be used to deliver fuel to an engine.

The fuel system 100 can include provisions for regulating the pressure of the fuel 108. In some embodiments, the fuel system 100 can include a fuel pressure regulator 130. The fuel pressure regulator 130 may be any device capable of regulating the fuel pressure of the fuel system 100. In other words, the fuel pressure regulator 130 may be capable of preventing the fuel pressure from rising above a regulated pressure at one or more portions of a fuel line. In an exemplary embodiment, the fuel pressure regulator 130 may be a variable type regulator. Examples of different fuel pressure regulators are discussed in detail below.

In different embodiments, the location of the fuel pressure regulator 130 can vary. In some cases, the fuel pressure regulator 130 may be disposed outside of the fuel tank 103. For example, in some return type fuel systems, the fuel pressure regulator 130 may be disposed adjacent to the fuel rails 102. In other cases, the fuel pressure regulator 130 may be disposed inside of the fuel tank 103. In an exemplary embodiment, which uses a returnless type fuel system, the fuel pressure regulator 130 may be disposed within the fuel tank 103. In particular, in some cases, the fuel pressure regulator 130 may be associated with a portion of the fuel line 110 that is disposed downstream of the fuel pump 120. With this arrangement, the fuel pressure regulator 130 can help to regulate the pressure of fuel being delivered to the fuel rails 102 from the fuel pump 120.

The fuel system 100 can include provisions for controlling various components. In some embodiments, the fuel system 100 may be associated with a computer or similar device configured to communicate, and in some cases control, the various components associated with the fuel system 100. In one embodiment, the fuel system 100 can be associated with an electronic control unit 150, hereby referred to as ECU 150.

The ECU 150 may include a number of ports that facilitate the input and output of information and power. The term "port" as used throughout this detailed description and in the claims refers to any interface or shared boundary between two conductors. In some cases, ports can facilitate the insertion and removal of conductors. Examples of these types of ports include mechanical connectors. In other cases, ports are interfaces that generally do not provide easy insertion or removal. Examples of these types of ports include soldering or electron traces on circuit boards.

All of the following ports and provisions associated with the ECU 150 are optional. Some embodiments may include a given port or provision, while others may exclude it. The following description discloses many of the possible ports and provisions that can be used, however, it should be kept in mind that not every port or provision must be used or included in a given embodiment.

The ECU 150 can include a port 151 for communicating with the fuel injectors 104. In some cases, the ECU 150 may be configured to transfer information and/or power to the fuel injectors 104 for injecting fuel into an engine. It will be understood that for purposes of clarity, a single port is used for communicating with the fuel injectors 104. However, in other embodiments, the ECU 150 could include additional ports for communicating with two or more fuel injectors independently. For example, in another embodiment, the ECU 150 could include eight ports that are configured to connect to each of the eight fuel injectors illustrated in the current embodiment.

The ECU 150 can include a port 152 for communicating with the fuel pump 120. In some cases, the ECU 150 may be configured to transfer information and/or power to the fuel pump 120. For example, using the port 152, the ECU 150 may send a control signal to the fuel pump 120 for operating the fuel pump 120 to obtain a desired fuel pressure within the fuel line 110.

The ECU 150 can include a port 153 for communicating with the fuel pressure regulator 130. In some cases, the ECU 150 may be configured to transfer information and/or power to the fuel pressure regulator 130. For example, in some cases, the ECU 150 could supply the fuel pressure regulator 130 with a voltage and/or current in order to modify the operation of the fuel pressure regulator 130.

For purposes of clarity, only some components of the fuel system 100 are illustrated in the current embodiment. Other embodiments could include additional components not shown here. For example, in another embodiment, the fuel system 100 could include one or more pressure dampers. Additionally, in some cases, the fuel system 100 could include one or more fuel filters. As another example, some embodiments could include sensors for detecting the operating conditions of the fuel system 100, including sensors for detecting the pressure inside any of the components of the fuel system 100. It will also be understood that in embodiments including additional components, the ECU 150 could include additional ports for communicating with these components.

Figure 2:
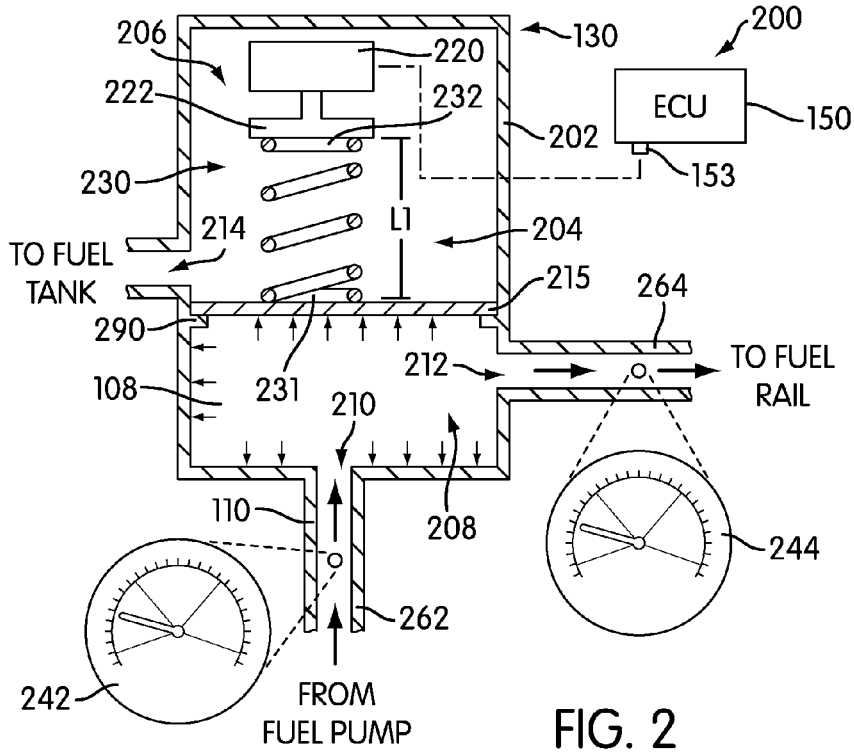
FIG. 2 is a schematic cross sectional view of an embodiment of a fuel pressure regulator.

FIGS. 2 through 5 illustrate schematic cross sectional views of an embodiment of a fuel pressure regulation system 200 that comprises the fuel pressure regulator 130 and the ECU 150. Referring to FIG. 2, the fuel pressure regulator 130 may include an outer wall 202 that bounds an interior cavity 204. In some cases, the interior cavity 204 may be divided into a first interior chamber 206 and a second interior chamber 208 by a sealing member 215. The term "sealing member" as used throughout this detailed description and in the claims refers to any member that may be used to prevent fluid communication between two chambers. It will be understood that any type of sealing member could be used. In some embodiments, various types of valves could be used as a sealing member. Examples of different valves that could be used include, but are not limited to: piston valves, slide valves, globe valves, sleeve valves, ball valves, diaphragm valves, needle valves, check valves, butterfly valves and poppet valves as well as any other type of valves. For purposes of clarity, the sealing member 215 is shown schematically in the current embodiment as a planar member that divides and seals the first interior chamber 206 from the second interior chamber 208.

A fuel pressure regulator can include provisions for allowing the sealing member 215 to move within the interior cavity 204. In the current embodiment, the sealing member 215 may be mounted directly to a spring 230. In particular, the sealing member 215 may be mounted to a first end portion 231 of the spring 230. Therefore, as the spring 230 compresses or extends, the sealing member 215 may translate with the first end portion 231 of the spring 230.

The fuel pressure regulator 130 can include one or more fluid ports. In some embodiments, the fuel pressure regulator 130 may include a first fluid port 210 that provides fluid communication between the second interior chamber 208 and a fuel pump. For example, in the current embodiment, fuel is delivered from the fuel pump 120 through an intake portion 262 of the fuel line 110 and the first fluid port 210 into the second interior chamber 208. In addition, the fuel pressure regulator 130 may include a second fluid port 212 that provides fluid communication between the second interior chamber 208 and one or more fuel rails. For example, in the current embodiment, fuel exits the second interior chamber 208 through the second fluid port 212 and travels through an outtake portion 264 of the fuel line 110 to the fuel rails 102.

In some embodiments, the fuel pressure regulator 130 may also include a third fluid port 214 that is in fluid communication with a fuel tank. In other words, fuel may also exit the interior cavity 204 at the third fluid port 214 and may be returned directly to the fuel tank. In some situations, this arrangement can help reduce the fuel pressure inside the second interior chamber 208 and downstream of the fuel pressure regulator 130.

Using this arrangement, the sealing member 215 and the spring 230 may comprise a pressure relief valve that helps to limit the pressure within the second interior chamber 208. In particular, the sealing member 215 may be configured in an open position that provides fluid communication between the third fluid port 214 and the second interior chamber 208. In other words, when the sealing member 208 is in the open position, fuel entering the first fluid port 210 can exit the second interior chamber 208 through both the second fluid port 212 and the third fluid port 214. In addition, the sealing member 215 may be configured in a closed position that prevents fluid communication between the third fluid port 214 and the second interior chamber 208. In other words, when the sealing member 215 is in a closed position, fuel entering through the first fluid port 210 can only exit the second interior chamber 208 through the second fluid port 212. Moreover, the sealing member 215 may be moved between the open and closed positions according to the pressure within the second chamber 208. In other words, if the pressure inside the second chamber 208 is high enough to overcome the spring force exerted by the spring 230, the sealing member 215 may be moved to the open position, which will provide pressure relief and prevent the pressure from rising above the regulated fuel pressure. If, on the other hand, the pressure inside the second chamber 208 is too low to overcome the spring force exerted by the spring 230, the sealing member 215 may remain in the closed position.

A fuel pressure regulator can include provisions for varying the force required to move a sealing member. In embodiments where the position of a sealing member is controlled using a spring, the fuel pressure regulator can include provisions for modifying the spring force. In one embodiment, a fuel pressure regulator can include a manually controlled actuator that compresses the spring and increases the spring force. In an exemplary embodiment, a fuel pressure regulator can include an electrically controlled actuator that compresses the spring using an electrical signal in order to increase the spring force.

The fuel pressure regulator 130 can include an electrical actuating device 220. The term "electrical actuating device" refers to any device capable of producing movement using a received electrical signal. Examples of different electrical actuating devices that can be used include, but are not limited to: electric motors and piezoelectric actuators, as well as other types of electrical actuating devices. In an exemplary embodiment, the electrical actuating device 220 is an electric motor that moves a platform 222. Moreover, in this case, the electrical actuating device 220 may receive control signals from the ECU 150 by way of the port 153. In particular, the ECU 150 may apply a voltage or current to electrical actuating device in a manner that controls the movement of the platform 222. With this arrangement, the movement of the platform 222 can be varied by adjusting the voltage and/or current supplied to the electrical actuating device 220.

In this embodiment, a second end portion 232 of the spring 230 may be mounted to the platform 222. Therefore, as the platform 222 is moved by the electrical actuating device 220, the spring 230 may be compressed to various lengths. By varying the compression of the spring 230, the amount of force required to move the sealing member 215 may also vary. With this arrangement, the regulated pressure of the fuel pressure regulator 130 can be varied by adjusting the compression of the spring 230, which changes the amount of force required to move the sealing member 215 between the open and closed positions.

It will be understood that in some embodiments, the fuel pressure regulator 130 can include provisions for maintaining the sealing member 215 in a fixed position as the spring 230 is compressed. In one embodiment, for example, the fuel pressure regulator 130 can include a stopping ring 290. In some cases, the stopping ring 290 may be integrally formed with the outer wall 202. The stopping ring 290 may have a diameter that is substantially smaller than the diameter of the sealing member 215 to prevent the sealing member 215 from moving past the stopping ring 290. With this arrangement, the position of the first end portion 231 of the spring 230, which is mounted to the sealing member 215, may be fixed when the sealing member 215 is in the closed position. Therefore, as the second end portion 232 of the spring 230 is moved, the length of the spring 230 can be adjusted to change the spring force.

Figure 3:
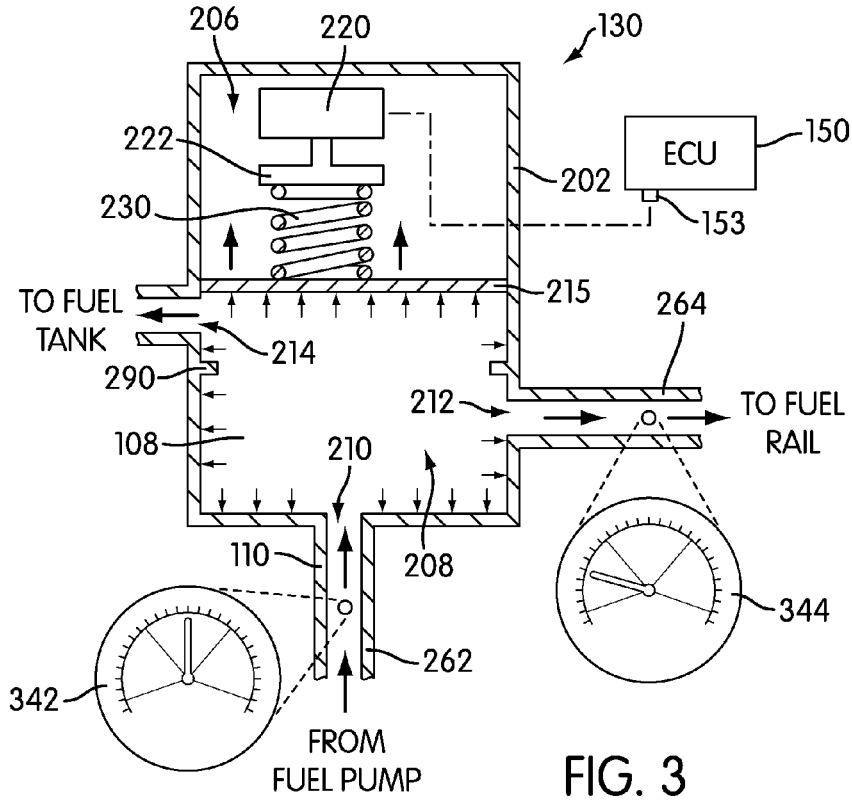
FIG. 3 is a schematic cross sectional view of an operation of the fuel pressure regulator of FIG. 2.

Referring to FIGS. 2 and 3, the operation of the fuel pressure regulator 130 is now discussed. Initially, the ECU 150 controls the electrical actuating device 220 to move the platform 222 to a first position. In this first position, the spring 230 may have length L1 which is associated with a first spring force. In an exemplary embodiment, the first spring force is selected to prevent the pressure in the second interior chamber 208 from rising above a first regulated pressure.

At this time, the fuel pressure within the second interior chamber 208 is not high enough to overcome the first spring force of the spring 230. Therefore, the sealing member 215 remains in a closed position that prevents fluid communication between the third fluid port 214 and the second interior chamber 208. As indicated by an intake pressure measurement 242 and an outtake pressure measurement 244, the pressure at an intake portion 262 of the fluid line 110 is substantially equal to the pressure at an outtake portion 264 of the fluid line 110. In other words, the pressures of the intake portion 262 and the outtake portion 264 are in substantial equilibrium.

As illustrated in FIG. 3, as the fuel pressure within the intake portion 262 of the fuel line 110 increases, indicated schematically by an intake pressure measurement 342, the fuel 108 within the second interior chamber 208 applies a greater force to the sealing member 215. In this case, the fuel pressure is high enough to overcome the first spring force and compress the spring 230. In other words, the fuel pressure is above the first regulated fuel pressure. As the spring 230 is compressed, the sealing member 215 moves to an open position in which the third fluid port 214 is in fluid communication with the second interior chamber 208. This prevents an increase in pressure within the outtake portion 264 of the fuel line 110 (indicated by an outtake pressure measurement 344) as fuel exits the second interior chamber 208 through the third fluid port 214 as well as the second fluid port 212. In other words, the third fluid port 214 provides pressure relief inside the fuel pressure regulator 130 as the sealing member 215 is moved past the third fluid port 214. This arrangement helps to prevent increases in fuel line pressure that could cause unwanted effects at the fuel injectors 104.

Figure 4:
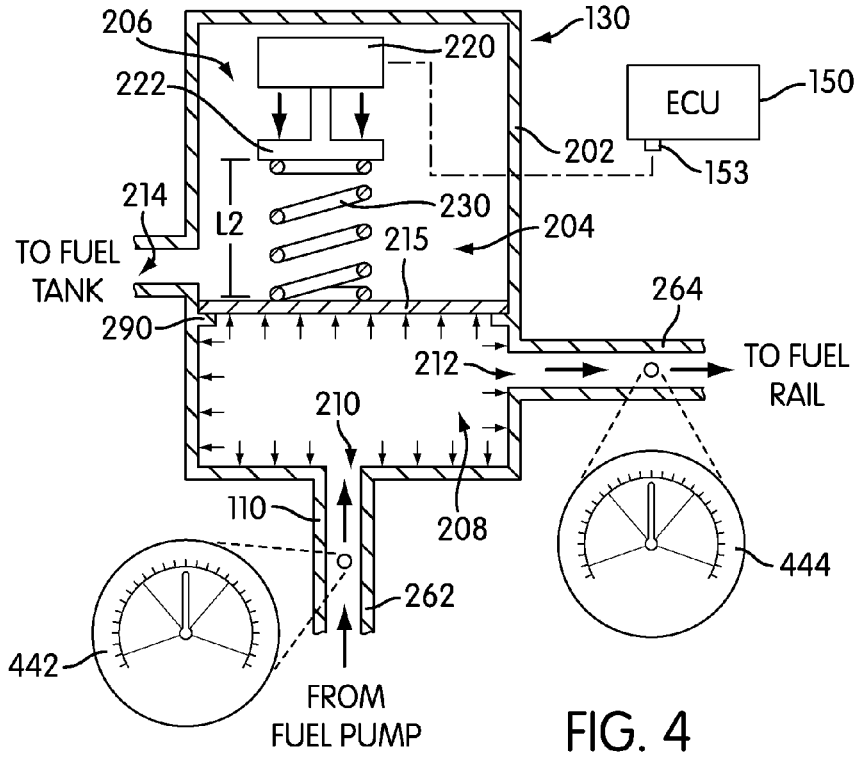
FIG. 4 is a schematic cross sectional view of an operation of the fuel pressure regulator of FIG. 2.
Figure 5:
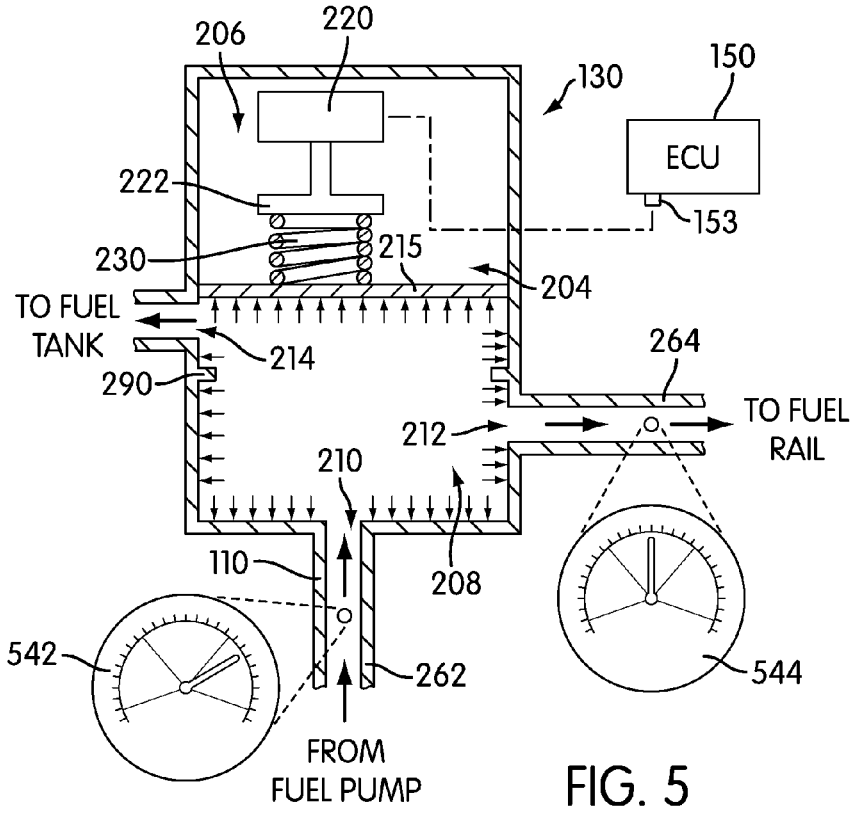
FIG. 5 is a schematic cross sectional view of an operation of the fuel pressure regulator of FIG. 2.

Referring now to FIGS. 4 and 5, the regulated fuel pressure of fuel system 100 can be increased by changing the compression of the spring 230 using the electrical actuating device 220. In this case, the ECU 150 may send a control signal to the electrical actuating device 220 to move the platform 222 to a second position. In this second position, the platform 222 may compress the spring 230 to length L2, which is substantially smaller than length L1 associated with the first position of the platform 222. By further compressing the spring 230, the spring force of the spring 230 is increased. In this case, the spring 230 may be associated with a second spring force that is selected to maintain a second regulated pressure that is greater than the first regulated pressure. This second spring force is substantially greater than the first spring force. Therefore, a greater fuel pressure is required to move the sealing member 215 past the third fluid port 214.

As indicated by an intake pressure measurement 442, the pressure inside the intake portion 262 has been increased. However, the fuel pressure within the second interior chamber 208 is not high enough to overcome the second spring force supplied by the spring 230. In other words, the fuel pressure is not greater than the second regulated fuel pressure. Therefore, the sealing member 215 remains in the closed position that prevents fluid communication between the third fluid port 214 and the second interior chamber 208. In this situation, the pressure inside the outtake portion 264 of the fluid line 110 (indicated by an outtake pressure measurement 444) remains in equilibrium with the pressure inside the intake fluid portion 262.

As the fuel pressure within the intake portion 262 of the fuel line 110 increases, indicated schematically by an intake pressure measurement 542, the fuel 108 within the second interior chamber 208 applies a greater force to the sealing member 215. In this case, the fuel pressure is high enough to overcome the second spring force and compress the spring 230. In other words, the fuel pressure is greater than the second regulated fuel pressure. As the spring 230 is compressed, the sealing member 215 moves to an open position in which the third fluid port 214 is in fluid communication with the second interior chamber 208. This prevents an increase in pressure within the outtake portion 264 of the fuel line 110 (indicated by an outtake pressure measurement 544) as fuel exits the second interior chamber 208 through the third fluid port 214 as well as the second fluid port 212. In other words, the third fluid port 214 provides pressure relief inside the fuel pressure regulator 130 as the sealing member 215 is moved past the third fluid port 214.

Using this arrangement, the regulated fuel pressure of the fuel pressure regulator 130 can be varied by controlling the spring force of the spring 230 with the electrical actuating device 220. Specifically, by applying varying voltages and/or currents, the ECU 150 may control the spring 230 to achieve a desired spring force and thereby obtain a desired regulated fuel pressure. The desired regulated fuel pressure can be selected according to various operating parameters including the current pressure within a fuel pump, the fuel tank pressure, the desired fuel injection amount, as well as any other operating parameters. Furthermore, by using a variable fuel pressure regulator, the fuel pressure regulator can be used directly in the fuel tank of a returnless type fuel system, which provides improved emissions and may eliminate the need for a high performance fuel pump.

Figure 6:
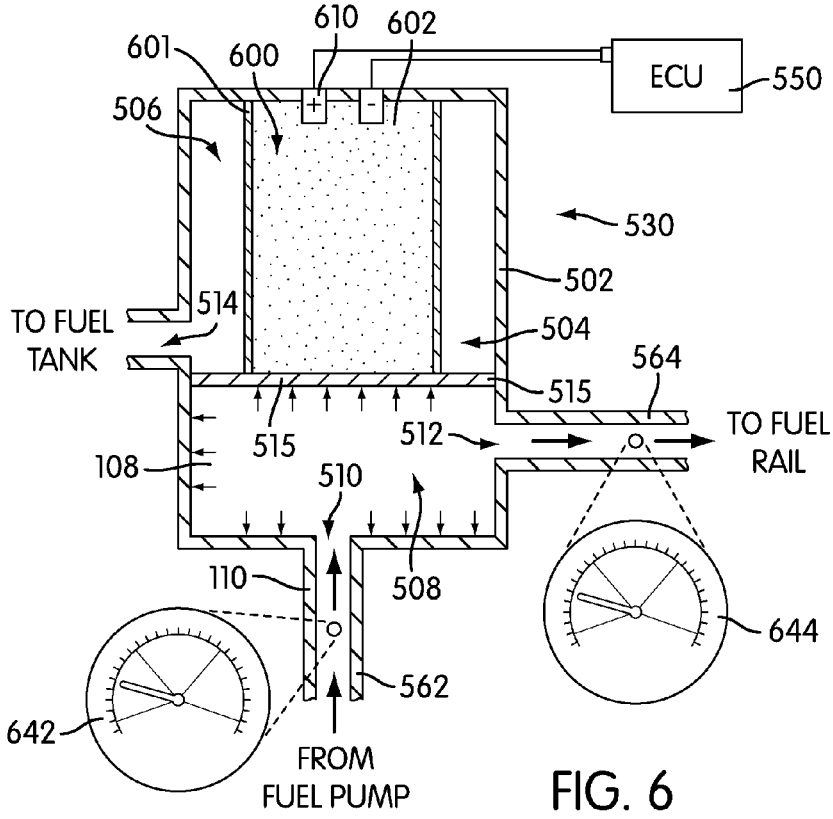
FIG. 6 is a schematic cross sectional view of an embodiment of a fuel pressure regulator.

FIGS. 6 through 9 illustrate schematic cross sectional views of another embodiment of a fuel pressure regulator 530 that may be used with the fuel system 100. Referring to FIG. 6, the fuel pressure regulator 530 may include an outer wall 502 that bounds an interior cavity 504. In some cases, the interior cavity 504 may be divided into a first interior chamber 506 and a second interior chamber 508 by a sealing member 515. The term "sealing member" as used throughout this detailed description and in the claims refers to any member that may be used to prevent fluid communication between two chambers. It will be understood that any type of sealing member could be used. In some embodiments, various types of valves could be used as a sealing member. Examples of different valves that could be used include, but are not limited to: piston valves, slide valves, globe valves, sleeve valves, ball valves, diaphragm valves, needle valves, check valves, butterfly valves and poppet valves as well as any other type of valves. For purposes of clarity, sealing member 515 is shown schematically in the current embodiment as a planar member that divides and seals the first interior chamber 506 from the second interior chamber 508.

The fuel pressure regulator 530 can include one or more fluid ports. In some embodiments, the fuel pressure regulator 530 may include a first fluid port 510 that provides fluid communication between the second interior chamber 508 and a fuel pump. For example, in the current embodiment, fuel is delivered from the fuel pump 120 through an intake portion 562 of the fuel line 110 and the first fluid port 510 into the second interior chamber 508. In addition, the fuel pressure regulator 530 may include a second fluid port 512 that provides fluid communication between the second interior chamber 508 and one or more fuel rails. For example, in the current embodiment, the fuel 108 exits the second interior chamber 508 through the second fluid port 512 and travels through an outtake portion 564 of the fuel line 110 to the fuel rails 102.

In some embodiments, the fuel pressure regulator 530 may also include a third fluid port 514 that is in fluid communication with a fuel tank. In other words, fuel may also exit the interior cavity 504 at the third fluid port 514 and may be returned directly to the fuel tank. In some situations, this arrangement can help reduce the fuel pressure inside the second interior chamber 508 and downstream of the fuel pressure regulator 530.

A fuel pressure regulator can include provisions for allowing the sealing member 515 to move within the interior cavity 504. In the current embodiment, the sealing member 515 may be mounted directly to a fluid filled member 600. The fluid filled member 600 may comprise a deformable outer membrane 601 and a fluid 602. The fluid 602 may be bounded within an interior chamber of the outer membrane 601 so that no fluid can leave the outer membrane.

The outer membrane 601 can be comprised of any type of flexible material that is impermeable to some kinds of fluid. Examples of materials that could be used include rubber, plastics as well as any other flexible and impermeable materials. The fluid 602 may comprise any type of fluid. In some embodiments, the fluid 602 may comprise a variable viscosity fluid. In some cases, the fluid 602 could be a smart fluid with a viscosity that changes under an applied electric field or magnetic field. Examples of smart fluids include electrorheological fluids and magnetorheological fluids. In an exemplary embodiment, the fluid 602 may be a magnetorheological fluid.

In the current embodiment, a first end portion 631 of the fluid filled member 600 may be mounted to a portion of the outer wall 502. In addition, a second end portion 632 of the fluid filled member 600 may be mounted to a portion of the sealing member 515. With this arrangement, as the fluid filled member 600 extends and compresses, the sealing member 515 may translate with the second end portion 632.

The fuel pressure regulator 530 can also include electrodes 610. The electrodes 610 may be embedded within a portion of the fluid filled member 600. In particular, the electrodes 610 may be in contact with the fluid 602. With this arrangement, as a voltage or current is applied to the electrodes 610, the viscosity of the fluid 602 may be varied.

It will be understood that depending on the viscosity of the fluid 602, the fluid filled member 600 may act as a fluid spring that may provide a restoring force following compression. Moreover, by using a magnetorheological fluid or any type of smart fluid, the viscosity of the fluid 602 can be modified by the application of an electrical signal of some kind. As the viscosity of the fluid 602 is modified, the effective spring force of the fluid filled member 600 can be varied. With this arrangement, the sealing member 515 and the fluid filled member 600 may comprise a pressure relief valve that helps to limit the pressure within the second interior chamber 508. In particular, the sealing member 515 may be configured in an open position that provides fluid communication between the third fluid port 514 and the second interior chamber 508. In other words, when the sealing member 515 is in the open position, fuel entering the first fluid port 510 can exit the second interior chamber 508 through both the second fluid port 512 and the third fluid port 514. In addition, the sealing member 515 may be configured in a closed position that prevents fluid communication between the third fluid port 514 and the second interior chamber 508. In other words, when the sealing member 515 is in a closed position, fuel entering through the first fluid port 510 can only exit the second interior chamber 508 through the second fluid port 512. Moreover, the sealing member 515 may be moved between the open and closed positions according to the pressure within the second interior chamber 208. In other words, if the pressure inside the second interior chamber 208 is high enough to overcome the force exerted by the fluid filled member 600, the sealing member 515 may be moved to the open position, which will provide pressure relief and prevent the pressure from rising above the regulated fuel pressure. If, on the other hand, the pressure inside the second chamber 508 is too low to overcome the force exerted by the fluid filled member 600, the sealing member 515 may remain in the closed position.

Figure 7:
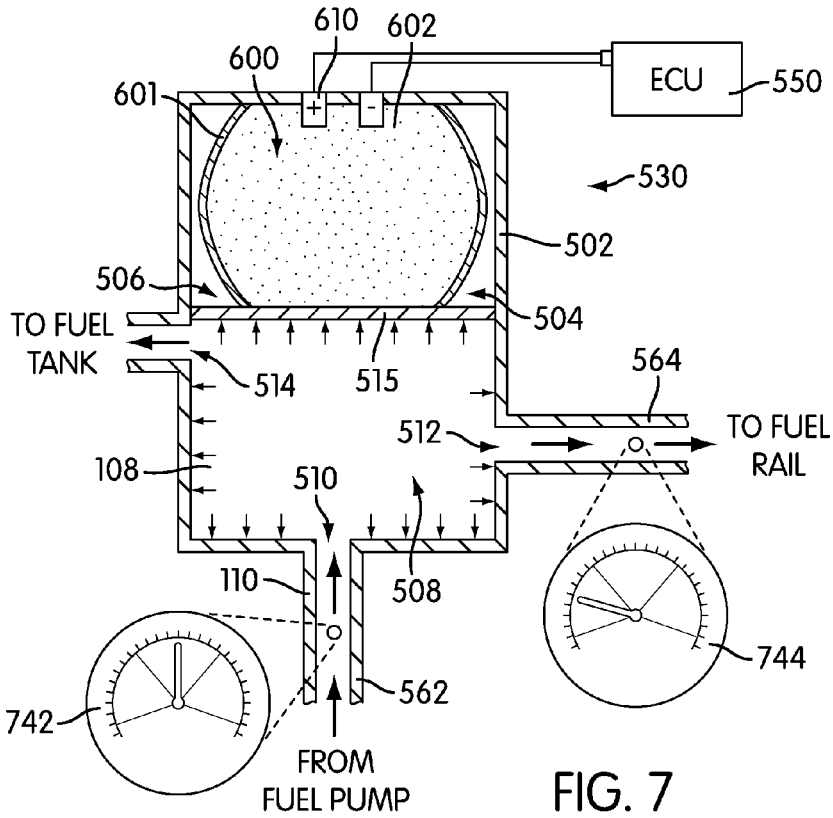
FIG. 7 is a schematic cross sectional view of an operation of the fuel pressure regulator of FIG. 6.

Referring to FIGS. 6 and 7, the operation of the fuel pressure regulator 530 is now discussed. Initially, an ECU 550 controls the viscosity of the fluid 602 using an applied voltage and/or current. In the current embodiment, the ECU 550 controls the fluid 602 to have a first viscosity that is associated with a first effective spring force. The term "effective spring force" as used throughout this detailed description and in the claims refers to the restoring force applied by the fluid filled member 600 in order to maintain the fluid filled member 600 in an initial, or equilibrium condition. In an exemplary embodiment, the first viscosity is selected to prevent pressure in the second interior chamber 508 from rising above a first regulated pressure.

At this time, the fuel pressure within the second interior chamber 508 is not high enough to overcome the first effective spring force of the fluid 602. In other words, the fuel pressure is not greater than the first regulated fuel pressure. Therefore, the sealing member 515 remains in a closed position that prevents fluid communication between the third fluid port 514 and the second interior chamber 508. As indicated by an intake pressure measurement 642 and an outtake pressure measurement 644, the pressure inside the fluid line 110 before entering the second interior chamber 508 is substantially equal to the pressure inside the fluid line 110 after leaving the fuel pressure regulator 530.

As the fuel pressure within the intake portion 562 of the fuel line 110 increases, indicated schematically by an intake pressure measurement 742, the fuel 108 within the second interior chamber 508 applies a greater force to the sealing member 515. In this case, the fuel pressure is high enough to overcome the first effective spring force and compress the fluid filled member 600. In other words, the fuel pressure is greater than the first regulated fuel pressure. As the fluid filled member 600 is compressed, the sealing member 515 moves to an open position in which the third fluid port 514 is in fluid communication with the second interior chamber 508. This prevents an increase in pressure within the outtake portion 564 of the fuel line 110 (indicated by an outtake pressure measurement 744) as fuel exits the second interior chamber 508 through the third fluid port 514 as well as the second fluid port 512. In other words, the third fluid port 514 provides pressure relief inside the fuel pressure regulator 530 as the sealing member 515 is moved past the third fluid port 514.

Figure 8:
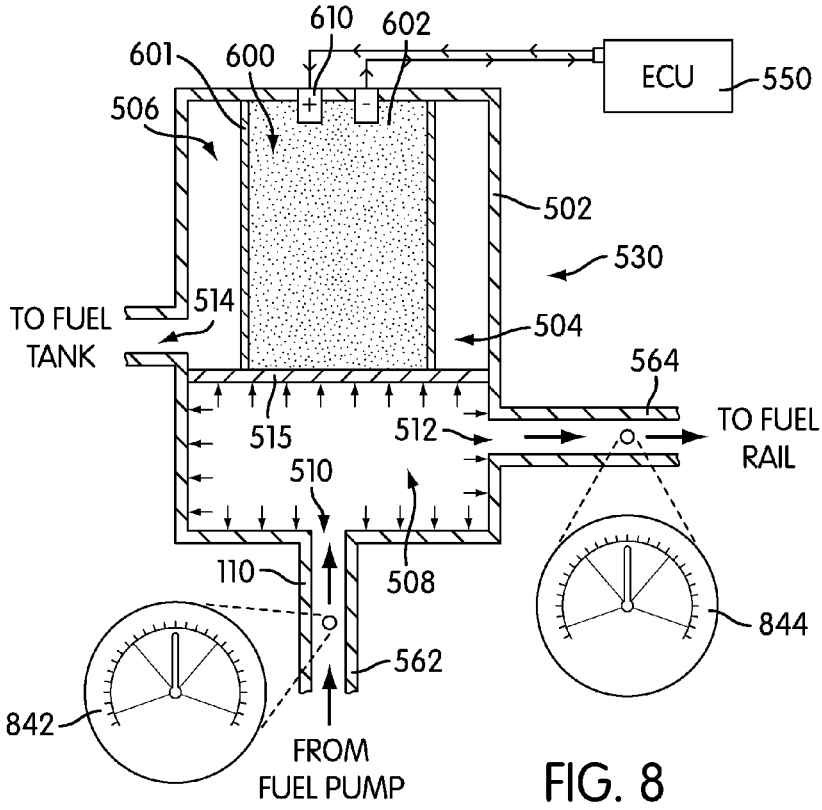
FIG. 8 is a schematic cross sectional view of an operation of the fuel pressure regulator of FIG. 6.
Figure 9:
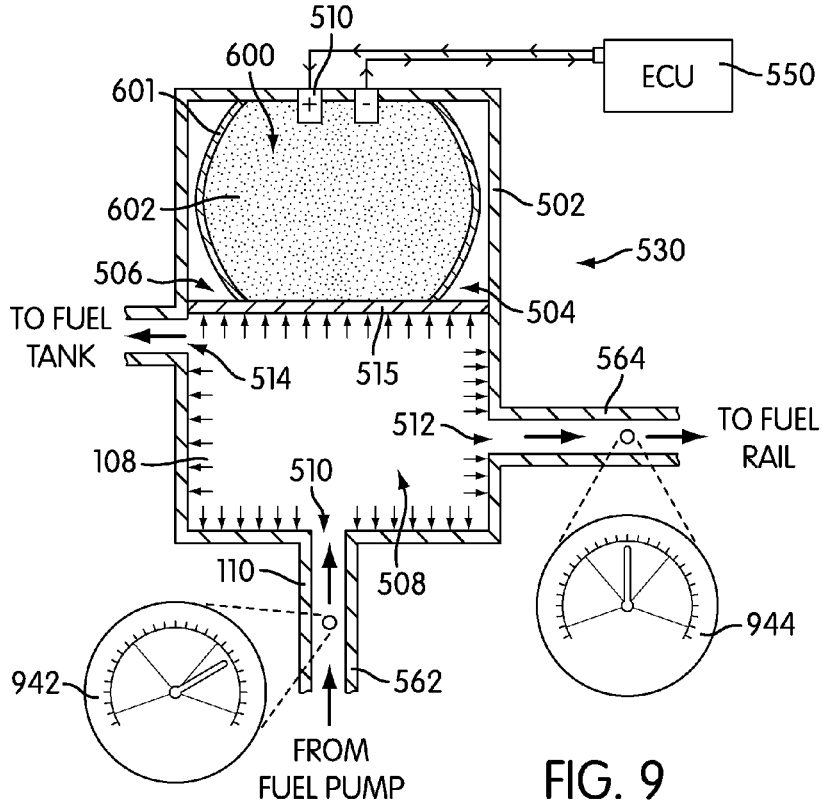
FIG. 9 is a schematic cross sectional view of an operation of the fuel pressure regulator of FIG. 6.

Referring now to FIGS. 8 and 9, the regulated fuel pressure of the fuel system 100 can be increased by changing the effective spring force of the fluid 602. In this case, the ECU 550 may apply a voltage and/or current across the electrodes 610. Under this applied electric field, the fluid 602 may acquire a second viscosity that is different than the first viscosity. In this case, the second viscosity may be greater than the first viscosity, which may modify the effective spring force of the fluid 602. In an exemplary embodiment, the fluid 602 may acquire a second effective spring force that is greater than the first effective spring force. Therefore, a greater fuel pressure is required to move the sealing member 515 past the third fluid port 514. In an exemplary embodiment, the viscosity of the fluid 602 is selected to prevent the pressure from rising above a second regulated pressure that is greater than the first regulated pressure.

As indicated by an intake pressure measurement 842, the pressure inside the intake portion 562 has increased. However, the fuel pressure within the second interior chamber 508 is not high enough to overcome the second effective spring force of the fluid 602. Therefore, the sealing member 515 remains in a position that prevents fluid communication between the third fluid port 514 and the second interior chamber 508. In this situation, the pressure inside the outtake portion 564 of the fluid line 110 (indicated by an outtake pressure measurement 844) remains in equilibrium with the pressure inside the intake fluid portion 562.

As the fuel pressure within the intake portion 562 of the fuel line 110 increases, indicated schematically by an intake pressure measurement 942, the fuel 108 within the second interior chamber 508 applies a greater force to the sealing member 515. In this case, the fuel pressure is high enough to overcome the second effective spring force and compress the fluid filled member 600. In other words, the fuel pressure is greater than the second regulated fuel pressure. As the fluid filled chamber 600 is compressed, the sealing member 515 moves to a position in which the third fluid port 514 is in fluid communication with the second interior chamber 508. This prevents an increase in pressure within the outtake portion 564 of the fuel line 110 (indicated by an outtake pressure measurement 944) as fuel exits the second interior chamber 508 through the third fluid port 514 as well as the second fluid port 512. In other words, the third fluid port 514 provides pressure relief inside the fuel pressure regulator 530 as the sealing member 515 is moved past the third fluid port 514.

Using this arrangement, the regulated fuel pressure of the fuel pressure regulator 530 can be varied by controlling the effective spring force of the fluid filled member 600. Specifically, by applying varying voltages and/or currents, the ECU 550 may control the fluid filled member 600 to achieve a desired effective spring force and thereby obtain a desired regulated fuel pressure. The desired regulated fuel pressure can be selected according to various operating parameters including the current pressure within a fuel pump, the fuel tank pressure, the desired fuel injection amount, as well as any other operating parameters. Furthermore, by using a variable fuel pressure regulator, the fuel pressure regulator can be used directly in the fuel tank of a returnless type fuel system, which provides improved emissions and may eliminate the need for a high performance fuel pump.

The arrangement discussed here is not intended to be limited to any type of fuel pressure regulator. In other embodiments, other pressure relief valve arrangements could be used. Additionally, in other embodiments other configurations for fluid ports could be used. Furthermore, the principles discussed here are not limited to any specific mechanism for relieving pressure in a fuel pressure regulator and could be applied to any system where an effective spring constant can be varied through an electrical signal of some kind.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A fuel pressure regulation system for a motor vehicle, comprising:

a fuel pressure regulator including a first fluid port for receiving pressurized fuel, a second fluid port in fluid communication with a fuel rail and a third fluid port for returning fuel to a fuel tank;

a fluid filled member being filled with a fluid having an adjustable viscosity, the fluid filled member including a set of electrodes and being capable of deforming;

a sealing member mounted to an end portion of the fluid filled member, the sealing member having a closed position that prevents fluid communication between the first fluid port and the third fluid port and the sealing member having an open position that allows fluid communication between the first fluid port and the third fluid port, the position of the sealing member being determined by the pressure inside the fuel pressure regulator and a viscosity of the fluid; and an electronic control unit configured to send electrical signals to the electrodes, the electronic control unit adjusting a regulated pressure of the fuel pressure regulator by sending electrical signals to the electrodes in order to adjust the viscosity of the fluid.

2. The fuel pressure regulation system according to claim 1, wherein the fluid is an electrorheological fluid.

3. The fuel pressure regulation system according to claim 1, wherein the fluid is a magnetorheological fluid.

4. The fuel pressure regulation system according to claim 1, wherein the fluid filled member comprises a deformable outer membrane that encloses the fluid.

5. The fuel pressure regulation system according to claim 1, wherein the electrical signal is an electric current.

6. The fuel pressure regulation system according to claim 1, wherein the regulated fuel pressure is increased as the viscosity of the fluid is increased.

7. The fuel pressure regulation system according to claim 6, wherein the viscosity of the fluid is increased as the electric current is increased.

8. A fuel pressure regulation system for a motor vehicle, comprising:

a fuel pressure regulator;

an electronic control unit in communication with the fuel pressure regulator, the electronic control unit adjusting a regulated pressure of the fuel pressure regulator using electrical signals;

wherein the fuel pressure regulator comprises a pressure relief valve; and wherein the pressure relief valve comprises a sealing member connected to a fluid filled member and electrodes for applying a current to the fluid filled member and wherein the fluid filled member is filled with a fluid having an adjustable viscosity.

9. The fuel pressure regulation system according to claim 8, wherein the fuel pressure regulator is disposed inside a fuel tank of the motor vehicle.

10. The fuel pressure regulation system according to claim 8, wherein the electronic control unit is in communication with a fuel pump and at least one fuel injector.

11. The fuel pressure regulation system according to claim 8, wherein the electrical signals are an electric current.

12. The fuel pressure regulation system according to claim 11, wherein the viscosity of the fluid is increased as the electric current is increased.

* * * * *